US007926688B2

(12) United States Patent
Dupuis et al.

(10) Patent No.: US 7,926,688 B2
(45) Date of Patent: Apr. 19, 2011

(54) TENSION-CONTROLLED WEB PROCESSING MACHINE AND METHOD

(75) Inventors: Louis Dupuis, St-Polycarpe (CA); Ross Hoge, Kirkland (CA); James Koehler, Mont Tremblant (CA)

(73) Assignee: Durst Phototechnik AG (IT)

( * ) Notice: Subject to any disclaimer, the term of this patent is extended or adjusted under 35 U.S.C. 154(b) by 1081 days.

(21) Appl. No.: 11/208,636

(22) Filed: Aug. 23, 2005

(65) Prior Publication Data

US 2007/0051218 A1 Mar. 8, 2007

(51) Int. Cl.

| | |
|---|---|
| ***B65H 20/02*** | (2006.01) |
| ***B65H 20/24*** | (2006.01) |
| ***B65H 23/185*** | (2006.01) |
| ***B65H 23/192*** | (2006.01) |
| ***B65H 23/198*** | (2006.01) |

(52) U.S. Cl. ..... 226/27; 226/29; 226/42; 226/44; 226/111; 226/117; 226/118.3; 242/418.1

(58) Field of Classification Search ..... 226/2, 4, 226/8, 24, 29, 30, 31, 32, 33, 42, 44, 111, 226/113, 114, 117, 118.2, 118.3, 120, 137; 242/417.3, 418.1; 101/181, 227, 228, 248, 101/484, 485, 486

See application file for complete search history.

(56) References Cited

U.S. PATENT DOCUMENTS

| | | | | |
|---|---|---|---|---|
| 2,205,838 | A * | 6/1940 | Redd | 74/125.5 |
| 4,011,976 | A * | 3/1977 | Greer | 226/8 |
| 4,372,206 | A | 2/1983 | Tison et al. | |
| 4,473,009 | A * | 9/1984 | Morgan | 101/232 |
| 4,657,164 | A * | 4/1987 | Felix | 226/42 |
| 4,716,802 | A | 1/1988 | O'Connor et al. | |
| 4,781,088 | A | 11/1988 | O'Connor et al. | |
| 4,805,111 | A * | 2/1989 | Steidel | 700/122 |
| 4,898,094 | A * | 2/1990 | Doumoto et al. | 101/485 |
| 5,115,737 | A | 5/1992 | Amendola | |
| 5,486,254 | A | 1/1996 | Gallagher et al. | |
| 6,067,778 | A * | 5/2000 | Yamamoto et al. | 53/451 |
| 6,273,313 | B1 * | 8/2001 | Noll et al. | 226/30 |
| 6,277,230 | B1 | 8/2001 | Milko | |
| 6,616,026 | B1 | 9/2003 | Wittmaier | |
| 6,929,838 | B1 * | 8/2005 | McNeil | 428/43 |

OTHER PUBLICATIONS

*RotoMetrics®*, as found on website www.rotometrics.com.
*Codimag—Viva 240*, as found on website www.codimag.fr.

* cited by examiner

*Primary Examiner* — Michael R Mansen
*Assistant Examiner* — Scott Haugland
(74) *Attorney, Agent, or Firm* — Ostrolenk Faber LLP

(57) ABSTRACT

A web processing assembly including first, second and third fixed spaced apart pairs of nip rollers moving the web respectively at a first, second and third speeds, the first and third speeds being constant and similar, the second speed being variable with a mean speed similar to the first and third speeds, a first idler roller engaging the web between the first and second pair of rollers and a second idler roller engaging the web between the second and third pair of rollers, each idler roller maintaining the web in constant tension by moving along a restrained path perpendicular to its axis to compensate for a difference between the variable second speed and the respective one of the constant first and third speeds. A method for processing a web and system for conveying a web are also disclosed.

11 Claims, 6 Drawing Sheets

TENSION-CONTROLLED WEB PROCESSING MACHINE AND METHOD

BACKGROUND OF THE INVENTION

1. Field of the Invention

The present invention relates to web processing machines, particularly to semi-rotary web processing machines.

2. Background Art

Web processing machines using a rotating tool cylinder processing successive sections of a continuous web of material include for example machine performing die cutting, laminating, stamping, printing, and coating. The successive sections are usually identical (i.e. repeats), and can be for example shapes to be cut, printed images, etc. The rotating tool is usually required to have the same tangential speed as the linear speed of the web when the tool is used to process each section of the web.

When the speed of the tool cylinder rotation and of the web are constant, the length of one section of web to be processed is usually equal to the circumference of the tool cylinder. As such, changing the length of the sections usually implies changing the tool cylinder. To reduce costs, a number of semi-rotary processes have emerged, allowing the use of a single tool cylinder for various sizes of web section. In most cases however, the modules performing the semi-rotary process cannot be used in series with other modules, since the web exiting the module usually travels at an intermittent speed, and as such is not compatible with a rotary process.

In web processing it is often desirable to perform multiple operations on a web, for example printing, laminating and cutting, through the use of several modules, one per operation to be performed, installed in series, i.e. with the web circulating through the modules and from one to the other in a continuous fashion. However, in such series the modules are usually dependent on one another for maintaining the web in tension, and as such a registry error at one module is reflected in all the downstream modules. As such, registry of the web at each module can be a complex procedure, usually done through modifying the speed or position of the multiple tool cylinders.

SUMMARY OF INVENTION

It is therefore an aim of the present invention to provide an improved web processing machine.

It is also an aim of the present invention to provide an improved method for processing a web.

It is a further aim of the present invention to provide an improved system for conveying a web between a tool cylinder and a corresponding anvil cylinder.

Therefore, in accordance with the present invention, there is provided a web processing assembly for a web processing module, the assembly comprising first, second and third fixed spaced apart pairs of nip rollers moving the web at a first, second and third speeds, the first and third speeds being constant and similar, the second speed being variable with a mean speed similar to the first and third speeds, and a first idler roller engaging the web between the first and second pair of rollers and a second idler roller engaging the web between the second and third pair of rollers, each of the first and second idler rollers maintaining the web in constant tension by moving along a restrained path perpendicular to an axis of the respective one of the first and second idler rollers to compensate for a difference between the variable second speed and the respective one of the constant first and third speeds.

Also in accordance with the present invention, there is provided a web processing machine for processing a web of material having a series of successive sections to be processed, the web processing machine comprising a constantly rotating tool cylinder having a predetermined circumferential length with at least a portion of the circumferential length defining at least one raised tool for processing an individual one of the sections, the tool rotating at a given tool tangential speed, a first pair of rollers upstream of the tool cylinder, the first pair of rollers pressing the web material therebetween and driving the web material at a first constant speed a second pair of rollers upstream of the tool cylinder and downstream of the first pair of rollers, the second pair of rollers pressing the web material therebetween and driving the web material at a cycling speed following a cycle corresponding to one rotation of the tool cylinder, the cycling speed corresponding to a mean speed similar to the first constant speed, the cycle including a period of constant speed similar to the tool tangential speed where the web travels in synchronism with the at least one tool processing a respective one of the sections, and a period of variable speed performing a re-register of a next one of the sections with the tool for the next rotation of the tool cylinder, the tangential speed being a function of the mean speed such that the at least one tool will be in register with the respective one of the sections, and a third pair of rollers downstream of the second pair of rollers, the third pair of rollers pressing the web material therebetween and driving the web material at a third constant speed similar to the first speed.

Further in accordance with the present invention, there is provided a method of processing a web comprising the steps of conveying a web into a first processing module at a constant speed, conveying the web through the first processing module at a first speed while maintaining a first tension on the web, the first speed having a mean corresponding to the constant speed, processing the web with a rotating tool in the first processing module, conveying the web from the first processing module to a second processing module at the constant speed, conveying the web through the second processing module at a second speed while maintaining a second tension on the web, the second tension being independent of the first tension, the second speed having a mean corresponding to the constant speed; and processing the web with a second rotating tool in the second processing module.

Further yet in accordance with the present invention, there is provided a system for conveying a web between a tool cylinder and a corresponding anvil cylinder, the system comprising a first motor driving the web upstream of and in proximity to the tool cylinder, a second motor driving the anvil cylinder, the anvil cylinder driving the tool cylinder, a third motor driving the web upstream of the first motor, a fourth motor driving the web downstream of the second motor, a first sensor sensing the position of a section of the web in proximity of the tool cylinder and generating first position data, a second sensor sensing the position of the tool and generating second position data, and a controller receiving the first and second position data, directing the first motor to drive the web at a cycling speed according to the first and second position data, and directing each of the second, third and fourth motors to drive the web at a constant speed similar to a mean speed of the first motor.

Further yet in accordance with the present invention, there is provided a method of processing a web, the method comprising the steps of constantly rotating a tool cylinder with an anvil cylinder, the tool cylinder having a circumferential surface defining a tool, moving a web between the tool cylinder and the anvil cylinder at a variable speed, subsequently detecting the position of each section to be processed on the web, detecting the position of the tool for each of the sections to be processed, and re-registering each section to be processed with the tool by adjusting the variable speed according to the position of the tool and the position of the section to be processed.

BRIEF DESCRIPTION OF THE DRAWINGS

Reference will now be made to the accompanying drawings, showing by way of illustration a preferred embodiment of the present invention and in which.

DESCRIPTION OF THE PREFERRED EMBODIMENTS

Figure 1:
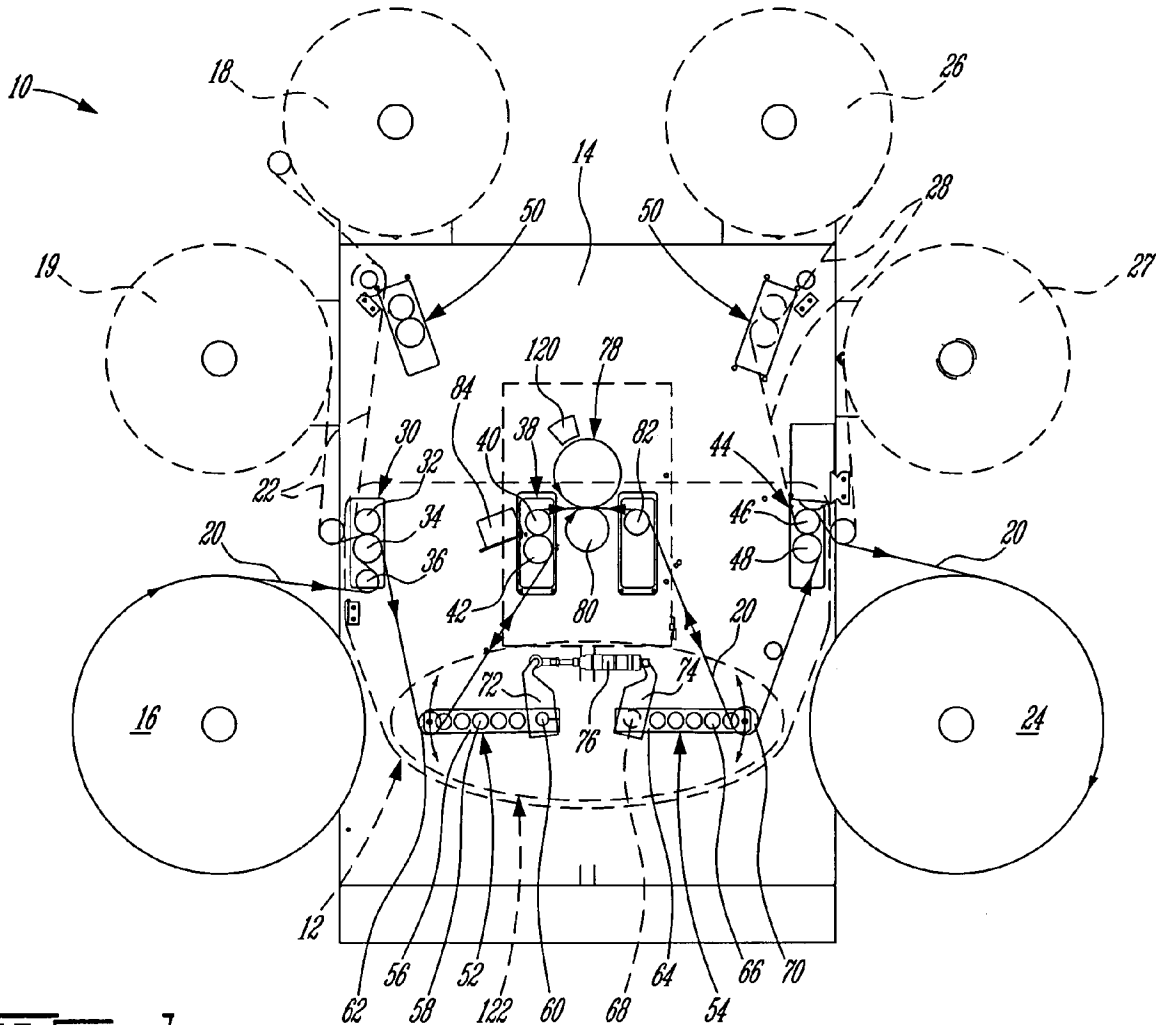
FIG. 1 is a front view of a web processing module according to an embodiment of the present invention.

Referring now to FIG. 1, a web processing module 10 according to the present invention is schematically shown. The web processing module 10 includes a body 14 supporting a web processing assembly 12, an unwind roll 16 preferably including lateral registering means (not shown), a tool cylinder 78 driven by an anvil cylinder 80, and rewind roll 24. The web processing assembly 12 allows a web 20 to be pulled from the unwind roll 16 at a constant speed, processed by the rotating tool cylinder 78 at a cycling speed or a constant speed, as required, and rewound on the rewind roll 24 at a constant speed. The web 20 can be, for example, paper, plastic film, label stock, etc. The unwind and/or rewind rolls 16,24 can be omitted if the web processing module 10 receives the web 20 from and/or feeds the web 20 to another web processing module.

The tool cylinder 78 can be, for example, a printing cylinder, a stamping cylinder, a die cutting cylinder, an embossing cylinder, a coating cylinder, etc. The tool cylinder 78 preferably includes a changeable plate around at least part of its circumference, with the plate defining a raised tool on a portion of the circumference only. The portion of the circumference not occupied by the tool does not contact the web 20 when it is aligned therewith. The raised tool corresponds to the length of the sections of the web 20 to be processed, and as such the same tool cylinder 78, with different plates, can be used with different section lengths. In a preferred embodiment, the tool cylinder 78 is magnetic, and the plates are flexible metallic plates adhered thereto. The anvil cylinder 80 is preferably a hardened steel roller and rotates at a constant speed.

The tool cylinder 78 can alternatively include a changeable plate defining a tool along its entire circumference. The tool can also be integral with the tool cylinder 7, with the tool being defined along part of or the entire circumference of the tool cylinder 78. The tool cylinder 78 can also be changed for a tool cylinder 78 of a different size, as required, without changing the remaining elements of the web processing assembly 12.

As shown in phantom, the body 14 can also support unwind and rewind rolls 18,19 for lamination material 22, which can be processed together with the web 20. The body 14 can also support a plurality of additional rewind rolls 26,27 for the web 20 or for waste material 28 which could be, for example, the waste matrix created during the process of die cutting.

The web processing assembly 12 includes a first cassette 30 pulling the web material 20 from the unwind roll 16 or from another upstream process. The first cassette 30 includes a first drive roll 32, a first nip roll 34 pressed against and under the first drive roll 32, and preferably a first nip idler 36 under the first nip roll 34. The first nip roll 34 is frictionally driven by the first drive roll 32. The first cassette 30 is located just downstream of the unwind roll 16, the web 20 being circulated from the unwind roll 16 in a "S" pattern under and around the idler 36, and between the nip roll 34 and drive roll 32. The nip roll 34 and drive roll 32 apply pressure to the web 20 so that it is essentially clamped, i.e. the web will not slide upon applying pressure thereto. The first cassette 30 pulls the web at a constant speed.

The web processing assembly 12 also includes, downstream of the first cassette 30, a second cassette 38. The second cassette 38 includes a second drive roll 40 and a second nip roll 42 pressed against and under the second drive roll 40 to be frictionally driven thereby. The second cassette 38 is located just upstream of the tool and anvil cylinders 78,80, with a plane being nearly tangential to the top of the drive roll 40 and to the bottom of the tool cylinder 78. The web 20 is circulated in a "S" pattern under the nip roll 42, between the nip roll 42 and drive roll 40, and over the nip roll 42 to go between the tool cylinder 78 and anvil cylinder 80 and over an idler roll 82 located downstream thereof. The nip roll 42 and drive roll 40 also apply pressure to the web so that it is essentially clamped. The second cassette 38 coordinates the movement of the web 20 with the constant rotating movement of the tool cylinder 78 such that each section to be processed is in register with the tool. The second cassette 38 pulls the web at a cycling speed. The mean value of the speed of the second cassette 38 is substantially equal to the constant speed of the first cassette 30. In cases where the circumference of the tool cylinder 78 is the same as a length of an individual section of the web 20 to be processed, the cycling speed corresponds to a constant speed (i.e. rotary process).

The web processing assembly 12 also includes, downstream of the second cassette 38 and of the tool cylinder 78, a third cassette 44. The third cassette 44 includes a third drive roll 46 and a third nip roll 48 pressed against and under the third drive roll 46 to be frictionally driven thereby. The web 20 is circulated in a "S" pattern under the nip roll 48, between the nip roll 48 and drive roll 46, and over the nip roll 46 to go to the rewind roll 24 or to another downstream process. The nip roll 48 and drive roll 46 also apply pressure to the web so that it is essentially clamped. The third cassette 44 pulls the web at a constant speed substantially equal to the constant speed of the first cassette 30.

The web processing module 10 can also include one or more additional cassettes 50 for driving lamination material, waste material, etc.

In order to maintain adequate tension of the web 20 between the cassettes 30,38,44 as well as to provide a smooth transition for the web 20 between the constant speed and the cycling speed, the web processing assembly 12 includes a tension maintenance system 122 including first and second dancer assemblies 52,54. The first dancer assembly 52 includes a first set of arms 56, the body of which preferably include a plurality of holes 58 for weight reduction purposes. The first set of arms 56 is pivotable about a first pivot 60 on one end, and supports a first idler roller 62 on the other end. The first idler roller 62 engages the web 20 between the first and second cassettes 30,38 and applies a given tension thereto. The second dancer assembly 54 similarly includes a second set of arms 64 with holes 66, pivotable about a second pivot 68 and supporting a second idler roller 70. The second idler roller 70 engages the web 20 between the second and third cassettes 38, 44 and applies the same given tension thereto. To maintain the tension, the first and second sets of arms 56,64 each include a bracket 72, 74 which are interconnected by an adjustable pneumatic cylinder 76.

The first and second idler rollers 62, 70, being each located between a constant and a cycling drive of the web 20, undergo a reciprocating motion under the action of the web 20 and as such act as a transition between the two driving modes. This reciprocating motion is directed along a restrained arcuate path defined by the rotation of the first and second pivotable set of arms 56,64. The idler rollers 62,70 maintain a constant tension on the web 20, which is adjusted through the pneumatic cylinder 76.

Numerous alternative configurations for the two idler rollers 62, 70 are also possible, one of which is the combination of the two pivots 60, 68 to have each set of arms 56,64 independently pivotable about a single pivot axis.

Figure 6:
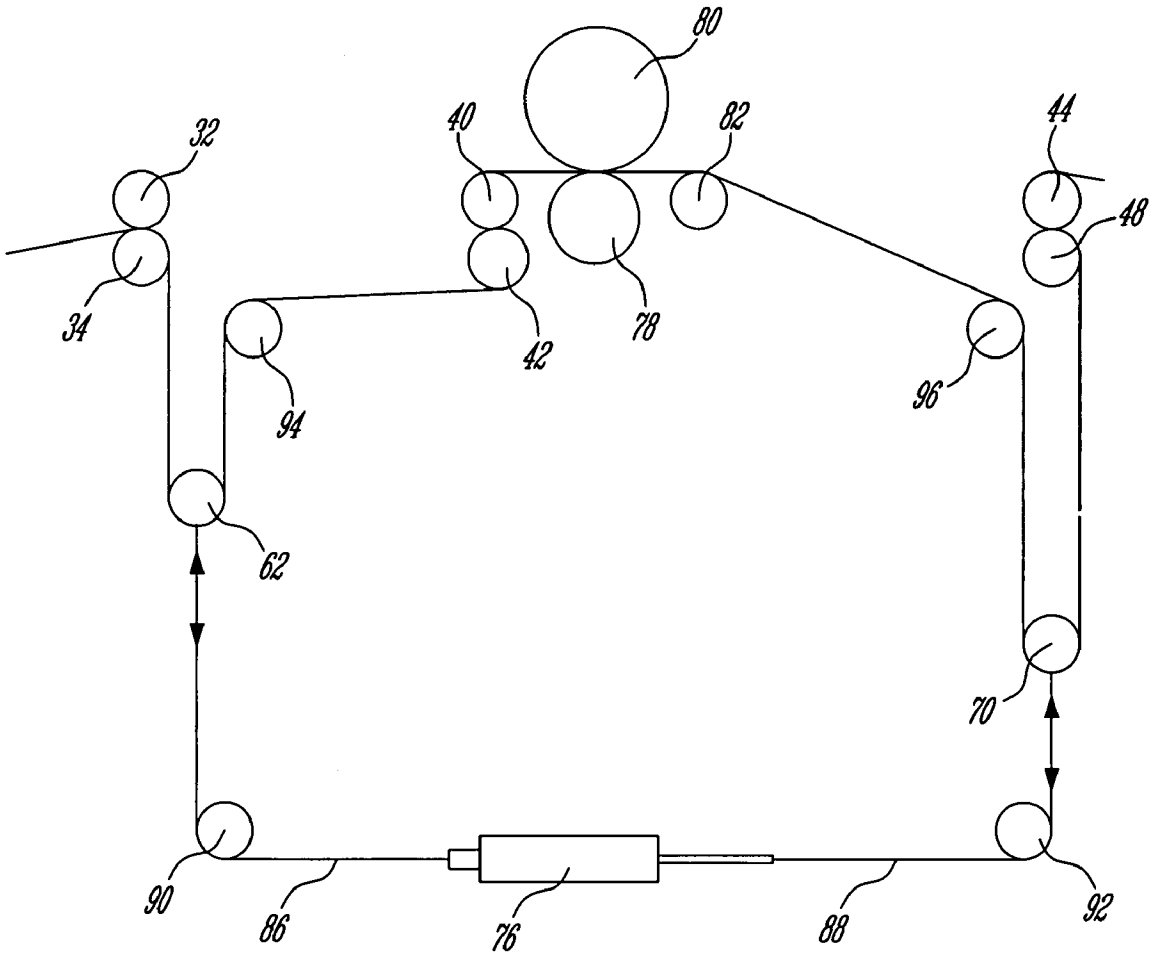
FIG. 6 is an alternative embodiment of the tension maintenance system for the web processing module of FIG. 1.

Another alternative configuration is illustrated in FIG. 6, where the first and second idler rollers 62,70 are respectively connected to a first and second cable or chain 86,88. The two cables 86,88 are each directed by a respective pulley 90,92 and interconnected by the pneumatic cylinder 76, so that the idler rollers 62,70 can undergo a vertical motion. Additional fixed idlers 94,96 direct the web 20 to accommodate the vertical motion of the idler rollers 62,70.

Alternatively, the pulleys 90,92 can be replaced by additional fixed idlers orienting the web 20 to accommodate a horizontal motion of the idler rollers 62,72, which are connected by cable or chain portions to the pneumatic cylinder 76.

The idler rollers 62, 70 can also be separate from each other, with their movement being coordinated electronically. The pneumatic cylinder 76 can be replaced by other means to create tension, such as an hydraulic cylinder or a spring system. In any case, the idler rollers 62, 70 have to maintain the web 20 in tension while each is moveable along a restrained path perpendicular to its axis to compensate for the speed differential of the web 20, with the tension of the web 20 preferably being adjustable.

Figure 3:
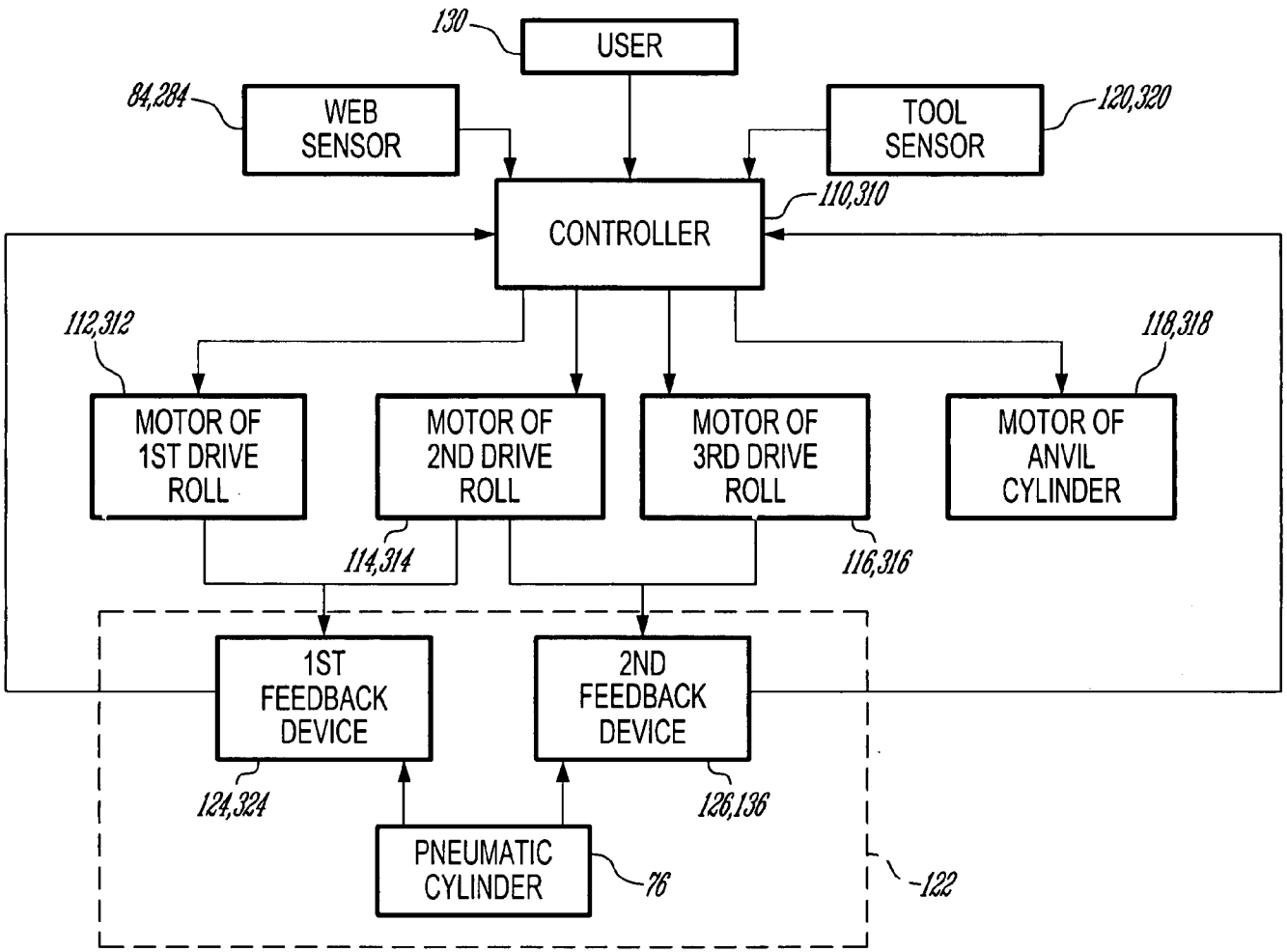
FIG. 3 is a block diagram of the control system of the web processing module of FIG. 1.

The web processing assembly 12 is controlled through the system illustrated in FIG. 3. A controller 110 sends a speed signal to four electronically controlled motors 112,114,116, 118 respectively driving the first drive roll 32, second drive roll 40, third drive roll 46 and anvil cylinder 80, with the anvil cylinder 80 driving the tool cylinder 78 (see FIG. 1). The signal sent to the first drive roll motor 112 is preferably the reference signal and as such is constant, so that the first drive roll motor 112 always rotates at the same constant speed. The third drive roll motor 116 and the anvil cylinder motor 118 both rotate at a constant speed, while the second drive roll motor 114 can rotate at a cycling speed, as will be further explained below.

While the web 20 is passing through the web processing assembly 12, the controller 110 receives a plurality of signals allowing it to adjust the speed of the remaining motors 114, 116,118. A web sensor 84, for example a contrast sensor, is preferably located in proximity to the second cassette 38, as close as possible to the tool cylinder 78 (see FIG. 1). This web sensor 84 determines the position of the section to be processed on the web 20, and send a signal to the controller 110 accordingly. A tool sensor 120 is also preferably provided to read the position of the tool on the tool cylinder 78 and send a signal to the controller 110.

In cases where the length of an individual section of the web 20 is different from the circumference of the tool cylinder 78, the web processing assembly 12 will perform in a semi-rotary manner. The controller 110 sends a cycling speed signal to the second drive roll motor 114 to compensate for the difference between the portion of the circumference of the tool cylinder 78 not covered by the tool and the distance between successive sections to be processed in the web 20. Thus, the cycling speed of the second drive roll motor 114 varies according to a cycle corresponding to a rotation of the tool cylinder 78. When the web 20 is in contact with the tool to process one section, the second drive roll motor 112 will drive the web 20 at a constant speed which is equal to the tangential speed of the tool. When the web 20 is not in contact with the tool, the second drive roll motor 112 will drive the web 20 at a variable speed allowing the web 20 to "catch up" to or "wait" for the next rotation of the tool, depending whether the circumference portion of the cylinder 78 is longer or shorter than the length of an individual section to be processed in the web 20. When the length of an individual section is shorter, the variable speed preferably includes a negative speed component, such that the web is intermittently "pulled back".

The cycling speed can be fixed, i.e. calculated by the controller following parameters of the web section and tool such that each cycle is the same during the entire process. However, the controller 110 preferably adjusts the cycling speed for each cycle according to the data received by the web sensor 84 and the tool sensor 120 to re-register the web 20 with the tool at each web section to be processed, while maintaining a constant mean speed of rotation for the second drive roll motor 114. The re-register allows corrections in register to be made upstream of the web processing, rather than conventional register done on measurements taken downstream of processing, i.e. after the web is processed in a misaligned manner and as such unusable. The re-register thus allow for a reduction in waste material.

In cases when the length of an individual section of the web 20 to be processed is equal to the circumference of the tool cylinder 78, i.e. the tool covers the entire diameter of the tool cylinder 78, the controller 110 can instruct the second drive roll motor 114 to rotate at a constant speed, and the web processing assembly 12 performs in a rotary manner. Preferably, the second drive roll motor 114 rotates at a cycling speed including a period of variable speed to re-register the web 20 with the tool upon receiving data from the web and tool sensors 84,120. It is understood that the order of magnitude of the speed variation in this case will be significantly less than in the true semi-rotary process described above.

The controller 110 can also receive a feedback signal from the tension maintenance system 122. The tension maintenance system 122 includes a first feedback device 124 monitoring the reciprocating movement of the first idler roller 62, and a second feedback device 126 monitoring the reciprocating movement of the second idler roller 70. The first and second feedback devices 124,126 are preferably respectively located at the first and second pivots 60,68 of the first and second set of arms 56,64 (see FIG. 1). Upon adjustment of the pneumatic cylinder 76 to adjust the tension of the web 20, the mean position of the reciprocating motion of the two idler rollers 62,70 will move away from a home position. For example, augmenting the pressure of the cylinder 76 will augment the web tension 20 and move the arms 56,64 downwardly, such that the mean position of the reciprocating motion of the two idler rollers 62,70 will drift down from its home position. The feedback devices 124,126 each send a signal to the controller 110 if such a change in the mean position of its respective idler roller 62,70 occurs.

In the absence of a signal from the feedback devices 124, 126, the controller 110 sets the speed of the second drive roll motor 114 so that the second drive roll 40 drives the web 20 at a mean speed equal to the constant speed of the web 20 at the first drive roll 32. The controller also sets the speed of the third drive roll motor 116 such that the third drive roll 46 drives the web 20 at a constant speed equal to the constant speed of the web 20 at the first drive roll 32. The mean speed of the web 20 throughout the entire web processing assembly 12 will be equal to the constant speed of the web 20 at the first and third drive rolls 32,46. The controller 110 preferably sets the ratio between the mean speed of the web 20 and the constant tangential speed of the anvil cylinder motor 118 (and as such the constant tangential speed of the tool cylinder 78) to be proportional to a ratio between the length of an individual section of the web 20 to be processed and the circumference of the tool cylinder 78. Preferably, the two ratios are equal, such that, for example, when the circumference of the tool cylinder 78 is double the length of an individual section of the web 20, the tangential speed of the tool cylinder 78 is double the mean speed of the web 20. When the circumference of the tool cylinder 78 and the length of an individual section of the web 20 are equal, the tangential speed of the tool cylinder 78 is equal to the mean speed of the web 20, and the web 20 is processed in a rotary manner.

When a signal from the first feedback device 124 is received, indicating a change in center position of the first idler roller 62, the controller 110 increments the speed of all the motors downstream to compensate for this change in center position until the center position of the reciprocating motion of the first idler roller 62 is back to its home position according to the first feedback device 124. Thus, the mean speed of the second drive roll motor 114, as well as the constant speed of the third drive roll motor 116 and of the anvil cylinder motor 118 are equally incremented. If a signal from the second feedback device 126 is received, indicating a change in center position of the second idler roller 70, the controller 110 increments the speed of the motor downstream, i.e. the speed of the third drive roll motor 116, until the center position of the reciprocating motion of the second idler roller 70 is back to its home position according to the second feedback device 126.

Figure 4:
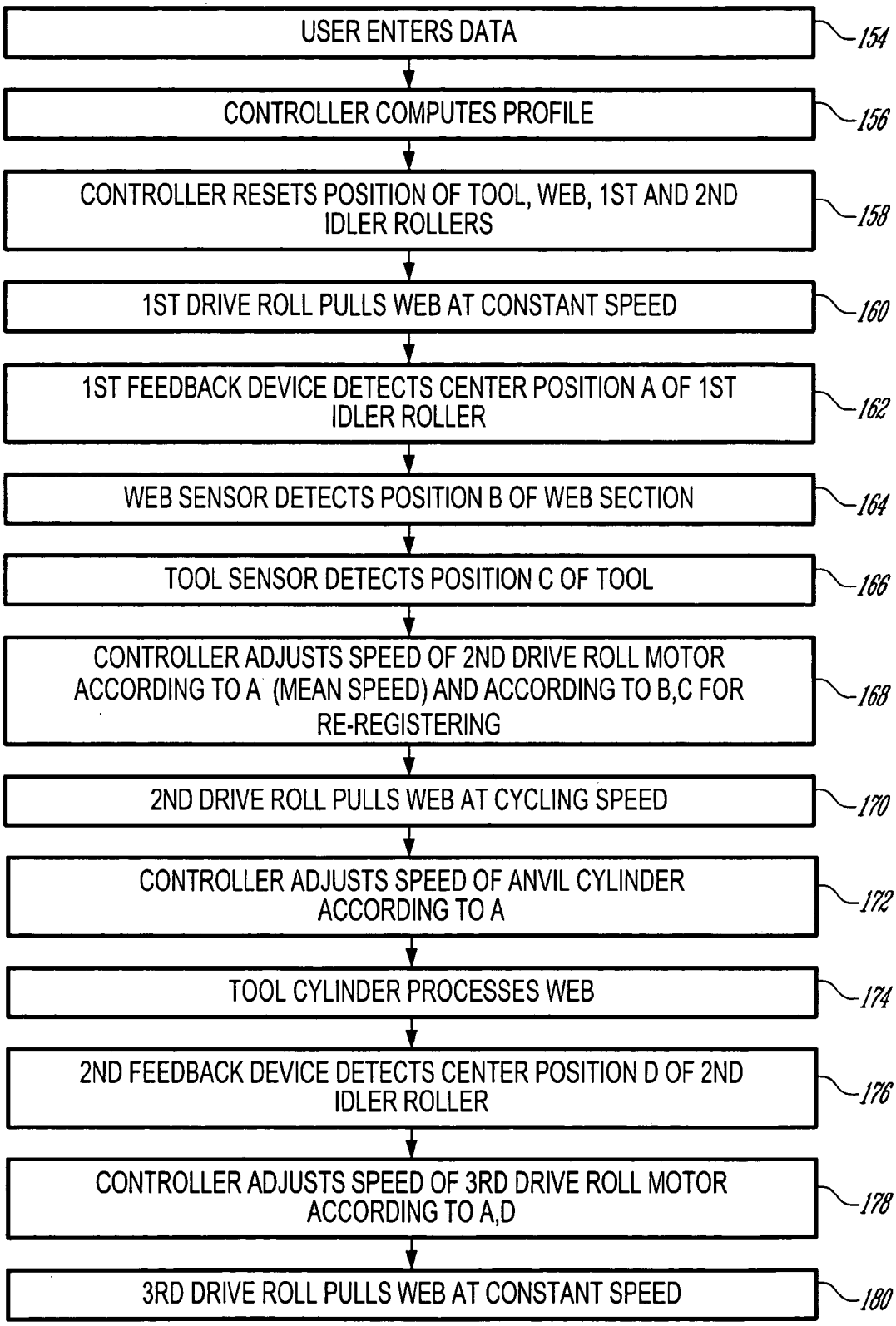
FIG. 4 is a flow chart illustrating the progression of the web in the web processing module of FIG. 1 or, similarly, in the first web processing module of FIG. 2.
Figure 5:
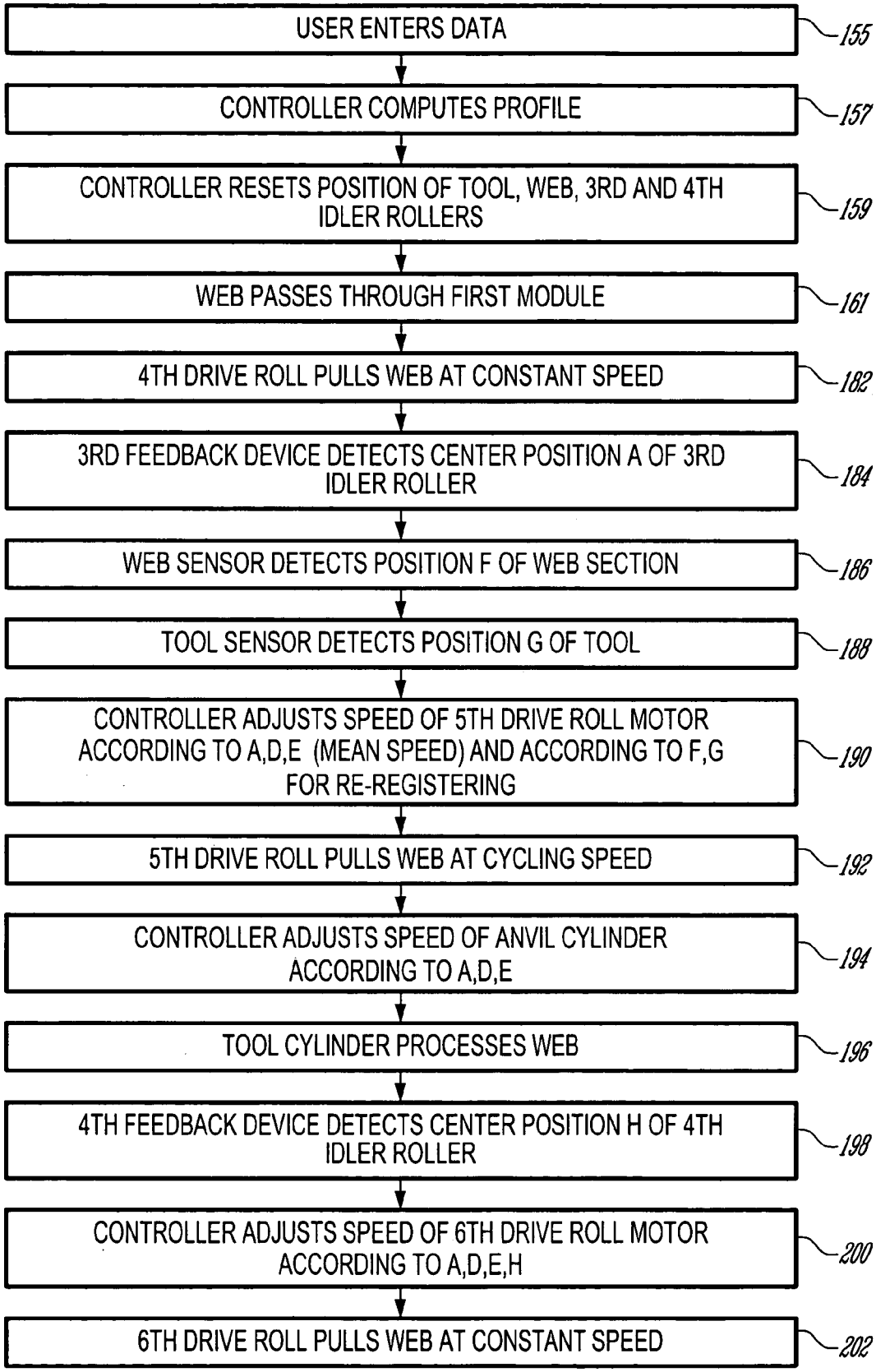
FIG. 5 is a flow chart illustrating the progression of the web in the second web processing module of FIG. 2.

In use, as illustrated in FIG. 4 with reference to the preceding Figures, the web 20 passes through the web processing module 10 according to the following: first, a user 130 provides data to the controller 110 on the process to be performed, e.g. ratio of the length of individual sections of the web with respect to the circumference of the tool cylinder, constant speed of the web 20 at the first cassette 30 or speed of rotation of the tool cylinder 78, etc., as indicated at 154. The controller 110 then computes the profile for the process, including the cycling speed at the second cassette 38, as indicated at 156. The controller 110 performs a reset on the position of the web 20, tool, and first and second idler rollers 62,70, by slowly moving the web 20 according to data received by the web and tool sensors 84,120 as well as the first and second feedback devices 124,126, as indicated at 158.

The web 20 can now be processed. The web 20 is pulled from the unwind roll 16 at a constant speed by the first drive roll 32, as indicated at 160. The web 20 travels at constant speed to the first idler roller 62. The center position A of the first idler roller 62 is detected by the first feedback device 124, as indicated at 162. The position B of the section of the web 20 near the tool cylinder 78 is detected by the web sensor 84 and the position C of the tool is detected by the tool sensor 120, as indicated respectively at 164 and 166. The controller 110 adjusts the cycling speed of the second drive roll motor 114 according to the tool and web section positions B and C to perform a re-register of the web 20 with the tool, and the mean cycling speed according to the first idler roller position A, as indicated at 168. The web 20 is pulled at the cycling speed by the second drive roll 40, as indicated in 170. The speed of the anvil cylinder 80 is adjusted by the controller 110 according to the first idler roller position A, see 172, and the web 20 is processed by the tool, as indicated at 174. The web 20 travels at cycling speed to the second idler roller 70. The center position D of the second idler roller 70 is detected by the second feedback device 126, as indicated at 176. The constant speed of the third drive roll motor 116 is adjusted by the controller 110 according to the first idler roller position A and the second idler roller position D, as indicated at 178. The web 20 is pulled at the constant speed by the third drive roll 46, as indicated at 180. of course, since the web 20 is continuous, all the above-described operations are done simultaneously, but were described here following the progression of a reference point of the web 20 for ease of understanding.

Figure 2:
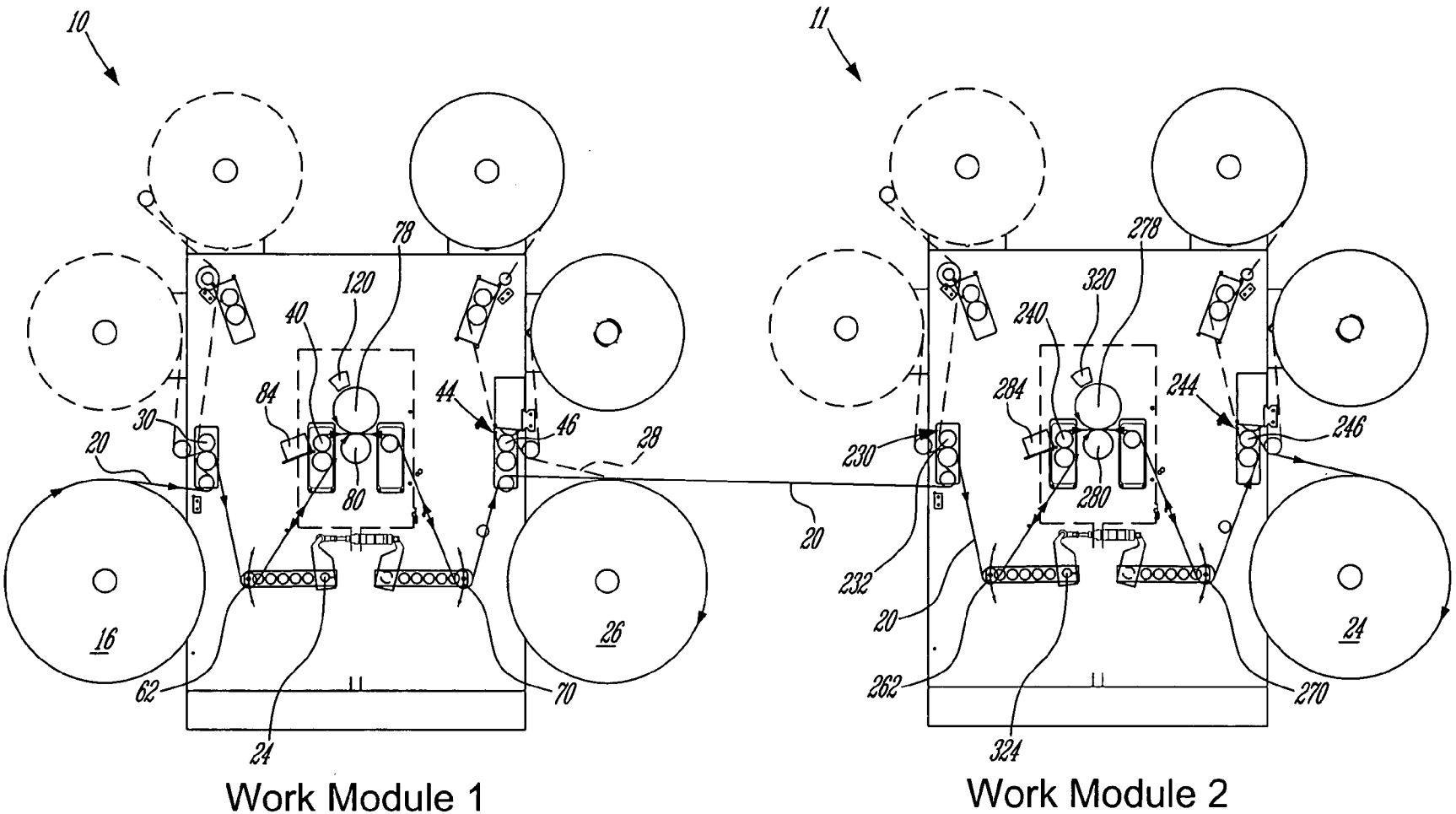
FIG. 2 is a front view of a web processing machine including the web processing module of FIG. 1 placed in series with a similar web processing module.

The web processing module 10 can be used in series with other similar modules 11. A series of two modules 10,11 is illustrated in FIG. 2. The rewind roll 24 for the web 20 is placed downstream of the second module 11. The second module is similar in construction to the first module 10, and as such will not be detailed here. The components of the second module 11 are represented by a reference numeral corresponding to the reference numeral of the corresponding component in the first module 10, augmented by 200. The drive rolls of the second module 11 are referred to as fourth, fifth and sixth drive rolls 232,240,246; the idler rollers, as third and fourth idler rollers 262,270; the feedback devices, as third and fourth feedback devices 324,326, etc.

The controller 310 of the second module 12 is in communication and synchronized with the controller 110 of the first module 110. Alternatively, a single controller can be used for both modules 10,11.

When the module 10 is used in series with the similar module 11, the third cassette 44 is preferably inactive, i.e. it does not drive the web and acts as an idler. Alternatively, the fourth cassette 230 can be inactive instead of the third cassette 44.

Before circulating the web through the first or second modules 11,12, the user 130 also provides data to the controller 310 of the second module on the process to be performed, as indicated at 155. The controller 310 then computes the profile for the process as indicated at 157. The controller 310 performs a reset on the position of the web 20, tool, and first and second idler rollers 262,270, by slowly moving the web 20 as indicated at 159. The web 20 is circulated through the first module 11, as indicated at 161 and as described above, except with steps 178 and 180 being omitted since in this case the third cassette 44 is inactive.

The web 20 then circulates through the module 11 according to the following: first, the web 20 is pulled from the first module 10 at a constant speed by the fourth drive roll 232, as indicated at 182, and travels at constant speed to the third idler roller 262. The center position E of the third idler roller 262 is detected by the third feedback device 324, as indicated at 184. The position F of the section of the web 20 near the tool cylinder 278 is detected by the web sensor 284 and the position G of the tool is detected by the tool sensor 320, as indicated respectively at 186 and 188. The controller 110 adjusts the cycling speed of the fifth drive roll motor 314 according to the tool and web section positions F and G to perform a re-register of the web 20 with the tool, and the mean cycling speed according to the first idler roller position A, the second idler roller position D and the third idler roller position E, as indicated at 190. The web 20 is pulled at the cycling speed by the fifth drive roll 240, as indicated in 192. The speed of the anvil cylinder 280 is adjusted by the controller 110 according to the first idler roller position A, the second idler roller position D and the third idler roller position E, see 194, and the web 20 is processed by the tool, as indicated at 196. The web 20 travels at cycling speed to the fourth idler roller 270. The center position H of the fourth idler roller 270 is detected by the fourth feedback device 326, as indicated at 198. The constant speed of the sixth drive roll motor 316 is adjusted by the controller 110 according to the first idler roller position A, the second idler roller position D, the third idler roller position E and the fourth idler roller position H, as indicated at 200. The web 20 is pulled at the constant speed by the sixth drive roll 246, as indicated at 202.

The tension in the web 20 can be advantageously adjusted to a different value in each module 10,11, since the first module 10 is isolated in tension from the second module 11 by the third or fourth cassette 44,230. The modules 10, 11 can also be used in a standard rotary manner, with the second and fifth drive rolls 40,240 pulling the web at a constant speed. As such, a plurality of modules such as 10 and 11 can be installed in series to perform multiple processes on a web, whether rotary or semi-rotary, each process being independent in tension from the others. The symmetry of the module 10 also allows for easily reversing of the direction of travel of the web 20 if another configuration is required.

The re-register step performed for each section also allows two modules such as 10,11 to be used independently, i.e. without having the web 20 run directly from one another, for a same web. For example, the first module 10 could print in each section of the web 20, and the second module 11 could die cut in each section, while easily registering the previously printed sections with the die.

Since the web 20 exiting the web processing module 10 is tension isolated and has an independent re-register, the module 10 can also be used in series with any number of rotating web processing machines.

A conveyor can also be located just downstream of the tool cylinder 78 in cases when the tool cylinder 78 is a cutting cylinder performing through cut or sheeting, such as to convey the cut elements of the web 20. In the case of through cut with matrix, the waste matrix passes through the second dancer assembly 54, through the third cassette 44, and is rewound on the rewind roll 24. In the case of sheeting, i.e. the web 20 is completely cut at each section, the second dancer assembly 54 is not used since there is no more web after the sheeting step is performed, and as such the second arm 64 is locked in place. The cut sheets are conveyed by the conveyor from the tool cylinder 78.

Other units, such as an infrared and/or ultraviolet drying unit, can be provided within the module 10 downstream of the tool cylinder 78, or in series with the module 10.

As mentioned above, the module 10 can thus easily be configured, by placing an appropriate tool plate around the tool cylinder 78, to perform multiple operations such as, but not limited to, die cutting, laminating, printing, coating, slitting, underscoring, perforating, etc. The tool cylinder 78 can also include more than one tool along its circumference, with the web 20 being "backed up" between each tool by the second cassette 38. In that case, the relation between the speed of the tool cylinder 78 and of the web 20 is adjusted accordingly. One example would be two separate perpendicular cutting dies, which would act on a same location on the section of the web 20 to perform a cross-shaped cut.

The embodiments of the invention described above are intended to be exemplary. Those skilled in the art will therefore appreciate that the foregoing description is illustrative only, and that various alternatives and modifications can be devised without departing from the spirit of the present invention. Accordingly, the present invention is intended to embrace all such alternatives, modifications and variances which fall within the scope of the appended claims.

I claim:

1. A web processing assembly for a web processing module, the assembly comprising:

first, second and third fixed spaced apart pairs of nip rollers moving the web at a first, second and third speeds, the first and third speeds being constant and similar, the second speed being variable with a mean speed similar to the first and third speeds;

a first dancer mechanism including a first arm pivotally mounted at a first end thereof and a first bracket rotatably fixed to the first end of the first arm, the first arm including a first idler roller mounted at a second end of the first arm, the first idler roller engaging the web between the first and second pair of rollers;

a second dancer mechanism including a second arm pivotally mounted at a first end thereof and a second bracket rotatably fixed to the first end of the second arm, the second arm including a second idler roller mounted at a second end of the second arm, the second idler roller engaging the web between the second and third pair of rollers; and an adjustment mechanism engaged with and supported only by the first and second brackets, respectively, the adjustment mechanism yieldably biasing the first and second brackets apart to apply tension to the web through the first and second arms and the first and second idler rollers, the first and second idler rollers moving with the first and second arms by action of the adjustment mechanism, such that the first and second idler rollers move along a restrained path perpendicular to an axis of the respective one of the first and second idler rollers to compensate for a difference between the variable second speed and the respective one of the constant first and third speeds.

2. The assembly according to claim 1, wherein the first and second idler rollers are respectively supported on the first and second arms such that each restrained path is an arc of circle.

3. The assembly according to claim 1, wherein the first and second idler rollers are interconnected by the adjustment mechanism including an actuator allowing the constant tension of the web to be set to a desired value.

4. The assembly according to claim 1, further comprising a feedback device producing a signal according to a difference between a mean position of each of the first and second idler rollers and a respective reference position, and a controller receiving the signal and adjusting at least one of the first, second and third speeds according to the signal to return the mean position to the respective reference position.

5. The assembly according to claim 1, further comprising a first sensor reading a position of each one of a plurality of successive sections of the web with respect to a tool of the web processing module, a second sensor reading a position of the tool, and a controller adjusting the second speed according to the position of the web and the position of the tool to re-register each one of the plurality of successive sections of the web with the tool.

6. The assembly according to claim 1, wherein the variable second speed includes two speed components directed in opposite directions.

7. A web processing machine for processing a web of material having a series of successive sections to be processed, the web processing machine comprising:

a constantly rotating tool cylinder having a predetermined circumferential length with at least a portion of the circumferential length defining at least one raised tool for processing an individual one of the sections, the tool rotating at a given tool tangential speed;

a first pair of rollers upstream of the tool cylinder, the first pair of rollers pressing the web material therebetween and driving the web material at a first constant speed;

a second pair of rollers upstream of the tool cylinder and downstream of the first pair of rollers, the second pair of rollers pressing the web material therebetween and driving the web material at a cycling speed following a cycle corresponding to one rotation of the tool cylinder, the cycling speed corresponding to a mean speed similar to the first constant speed, the cycle including a period of constant speed similar to the tool tangential speed where the web travels in synchronism with the at least one tool processing a respective one of the sections, and a period of variable speed performing a re-register of a next one of the sections with the tool for the next rotation of the tool cylinder, the tangential speed being a function of the mean speed such that the at least one tool will be in register with the respective one of the sections;

a third pair of rollers downstream of the second pair of rollers, the third pair of rollers pressing the web material therebetween and driving the web material at a third constant speed similar to the first speed;

a first dancer mechanism including a first arm pivotally mounted at a first end thereof and a first bracket rotatably fixed to the first end of the first arm, the first arm including a first idler roller mounted at a second end of the first arm, the first idler roller engaging the web between the first and second pair of rollers;

a second dancer mechanism including a second arm pivotally mounted at a first end thereof and a second bracket rotatably fixed to the first end of the second arm, the second arm including a second idler roller mounted at a second end of the second arm, the second idler roller engaging the web between the second and third pair of rollers; and an adjustment mechanism engaged with and supported only by the first and second brackets, respectively, the adjustment mechanism yieldably biasing the first and second brackets apart to apply tension to the web through the first and second arms and the first and second idler rollers, the first and second idler rollers moving with the first and second arms by action of the adjustment mechanism, such that the first and second idler rollers move along a restrained path perpendicular to an axis of the respective one of the first and second idler rollers to compensate for a difference between the variable second speed and the respective one of the constant first and third speeds.

8. The web processing machine according to claim 7, wherein the first idler roller applies an adjustable tension to the web between the first and second pair of rollers, and the second idler roller applies the same adjustable tension to the web between the second and third pair of rollers, the first and second idler rollers undergoing a reciprocating motion compensating respectively for a difference between the first speed and the cycling speed and for a difference between the cycling speed and the third speed.

9. The web processing machine according to claim 8, wherein the first idler roller is retained on the first arm, the second idler roller is retained on the second arm, and the first and second set of pivotable arms are interconnected by the adjustment mechanism including an actuator producing the adjustable tension in the web.

10. The web processing machine according to claim 8, further comprising first and second feedback devices monitoring a mean position of respectively the first and second idler rollers and comparing the mean position with a respective reference position, the first feedback device acting through a controller to increment the cycling and third speeds to return the mean position of the first idler roller to the respective reference position, the second feedback device acting through the controller to increment the third speed to return the mean position of the second idler roller to the respective reference position.

11. The web processing machine according to claim 7, further comprising at least one sensor adjacent to the second pair of rollers, the at least one sensor reading a position of the successive sections of the web with respect to the at least one tool and adjusting the cycling speed to adjust for variations in the register of each of the successive sections of the web with the at least one tool.

* * * * *